US005513911A

United States Patent [19]

Schwing

[11] Patent Number: 5,513,911

[45] Date of Patent: May 7, 1996

[54] VEHICLE MIXER

[75] Inventor: Friedrich Schwing, Gelsenkirchen, Germany

[73] Assignee: Stetter G.m.b.H., Memmingen, Germany

[21] Appl. No.: 520,706

[22] Filed: Aug. 29, 1995

[30] Foreign Application Priority Data

Sep. 3, 1994 [DE] Germany ..... 44 31 501.5

[51] Int. Cl.[6] ..... B28C 7/04; B28C 5/18

[52] U.S. Cl. ..... 366/40; 366/59; 366/169.100; 366/181.100; 366/180.100

[58] Field of Search ..... 366/40, 36, 41, 366/44, 53, 54, 55, 56, 57, 59, 61, 62, 63, 27, 167, 173, 180, 181, 220

[56] References Cited

U.S. PATENT DOCUMENTS 2,280,513 4/1942 Jaeger et al. ..... 366/56
4,462,690 7/1984 Wirtgen ..... 366/57
4,478,514 10/1984 Hudelmaier ..... 366/40
4,900,154 2/1990 Waitzinger ..... 366/56

*Primary Examiner*—Robert W. Jenkins
*Attorney, Agent, or Firm*—Notaro & Michalos

[57] ABSTRACT

In a mixing drum (16) of a vehicle mixer is supported a coaxial pipe (24) which together with a closure element (36) and a feeding hopper (42) forms a constructional unit. The pipe (24) is supported by two bearings of the mixing drum (16) so as to be relatively rotatable and longitudinally displaceable. The closure element (36) serves for closing a tail opening (20) of the drum (16) and can be adjusted axially with the central pipe (24) by means of an adjusting device in order to open or close the tail opening (20) of the drum. The pipe (24) extends nearly over the entire length of the mixing drum and ensures the vibration-free bearing of the closure element so that between it and the drum mouth during driving, no relative shifts can occur which would damage the drum mouth sealing. The constructional unit can be pulled as a unit from the mixing drum so that maintenance work can readily be carried out.

14 Claims, 4 Drawing Sheets

VEHICLE MIXER

FIELD AND BACKGROUND OF THE INVENTION

The invention relates to a vehicle mixer for flowable media such as cement, with a mixing drum rotatable on a chassis.

Such a vehicle mixer is known from U.S. Pat. No. 2,303,902. The closure element for the mouth of the drum comprises a pipe socket of a feeding hopper and projects axially into the drum mouth. A central pipe is only provided in the rear region of the drum and is fastened on radial arms of the drum. Penetrating the feeding hopper is a sleeve with which the feeding hopper is displaceably supported on the pipe. The short pipe fastened at one end cannot support the feeding hopper in such a way that vibrations are avoided. Vibrations of the pipe lead to leaking in the region of the annular sealing between the drum mouth and the closure element. The fixedly installed pipe represents a hindrance to maintenance work in the interior of the mixing drum.

SUMMARY OF THE INVENTION

It is the task of the invention to improve the support of the closure element of the mixing drum in order to improve sealing.

This task is solved according to the invention by providing the pipe and the closure element as one construction unit with the pipe extending along most of the length of the mixing drum.

The constructional unit comprising the closure element and the pipe, preferably also includes the feeding hopper, and can be removed from the drum as a unit and again be replaced. This facilitates maintenance work. At least two pivot bearings in the drum for rotation and sliding bearing on the pipe, are preferably disposed in the proximity of the drum ends, thus ensuring even under large static and dynamic loading, a low-vibration support of the closure element with feeding hopper on the drum. This is critical for the uniform tight sealing of the closure element on the drum mouth.

An especially advantageous further development of the invention lies in that the pipe assumes an additional function in the interior of the drum due to a pressurized water connection and a number of water exit nozzles. The quantity of mixing water called for in the recipe can very effectively be added to the dry cement mixture. The distribution of the water takes place more uniformly and faster. It is preferred that the majority of the nozzles are directed obliquely and vertically upwardly. For this reason the majority of the nozzles are preferably disposed in the upper half of the pipe.

A further embodiment of the invention consists in disposing removable abrasion sleeves on the pipe in the region of its bearings in the mixing drum. In the connection with the hydraulic feed into the pipe this abrasion protection can very simply be cleaned and lubricated with leakage water from the pipe. This extends the service life. The nozzles in the pipe are preferably self-closing and equipped with replaceable abrasion protection.

BRIEF DESCRIPTION OF THE DRAWINGS

In conjunction with the drawing representing an embodiment example of the invention, the latter will be described in further detail.

In the drawings.

DESCRIPTION OF THE PREFERRED EMBODIMENT

Figure 1:
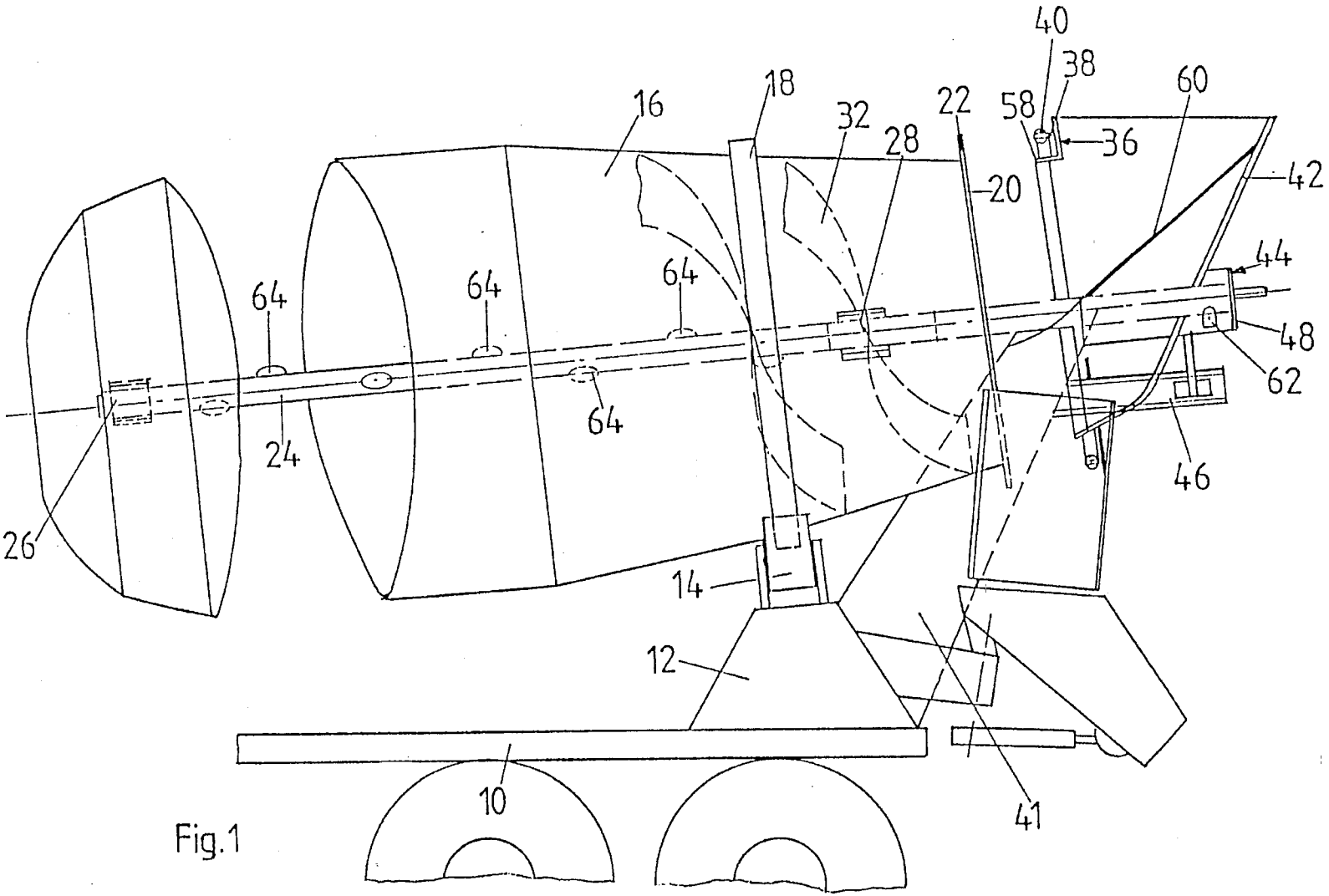
FIG. 1 is a side view of a mixing drum supported on a vehicle chassis, with adjustable closure device.
Figure 3:
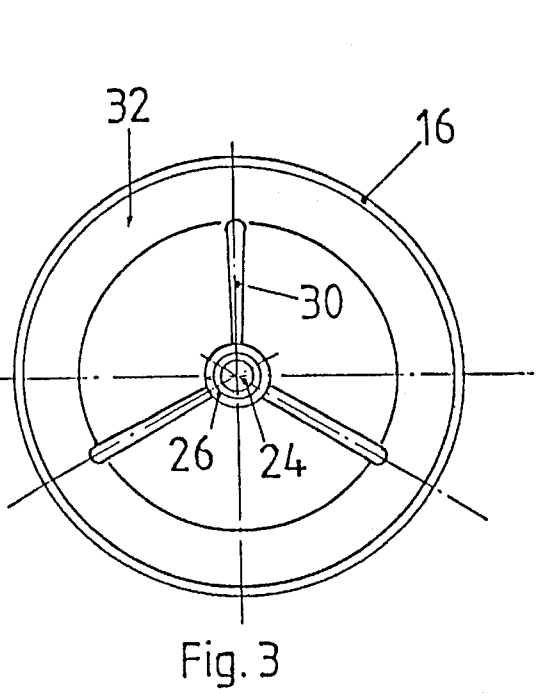
FIG. 3 is a front view of the pipe bearing in the mixing drum.
Figure 2:
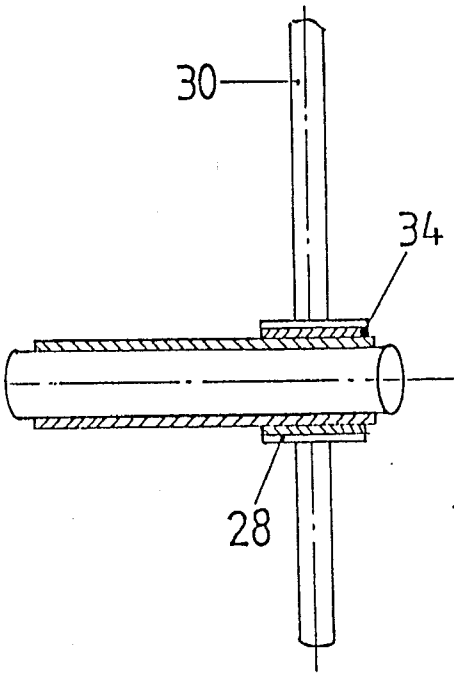
FIG. 2 is an axial section through the bearing of the central pipe within the mixing drum.
Figure 2:
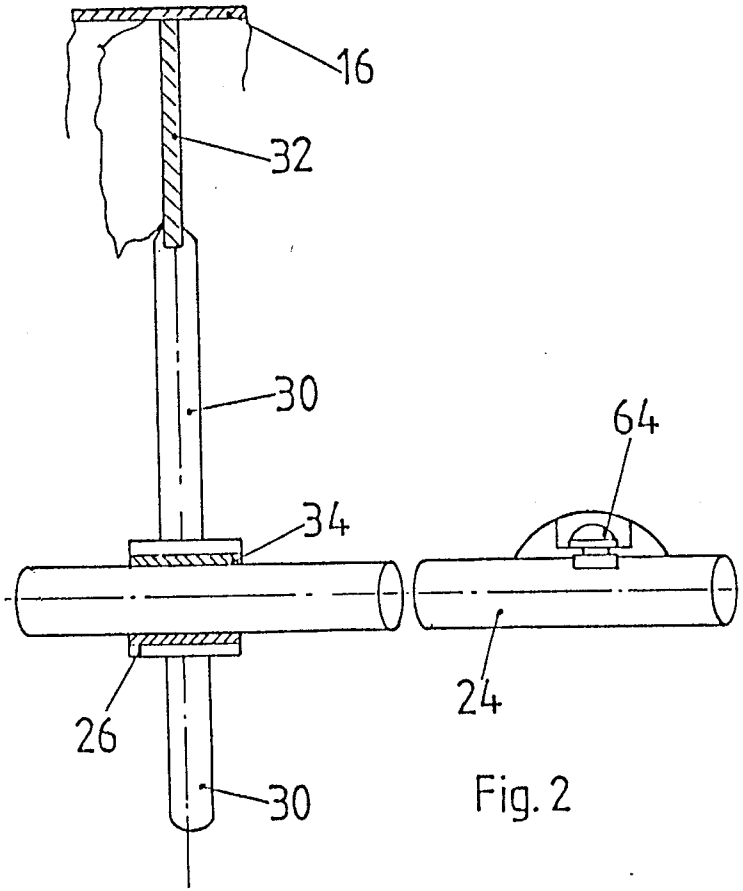

A bearing block 12 with rollers 14 on which a mixing drum 16 is rotatably supported via a running tread 18 in the tail region of a mixing drum, is disposed on a vehicle chassis 10. The mixing drum 16 comprises a drum mouth 20 at its tail side, which is delimited by an annular flange 22. At the opposing front-side end the mixing drum 16 is closed and has a central journal (not shown) serving as a bearing and rotational drive for the drum. To this extent the mixing drum is prior art.

Figure 4:
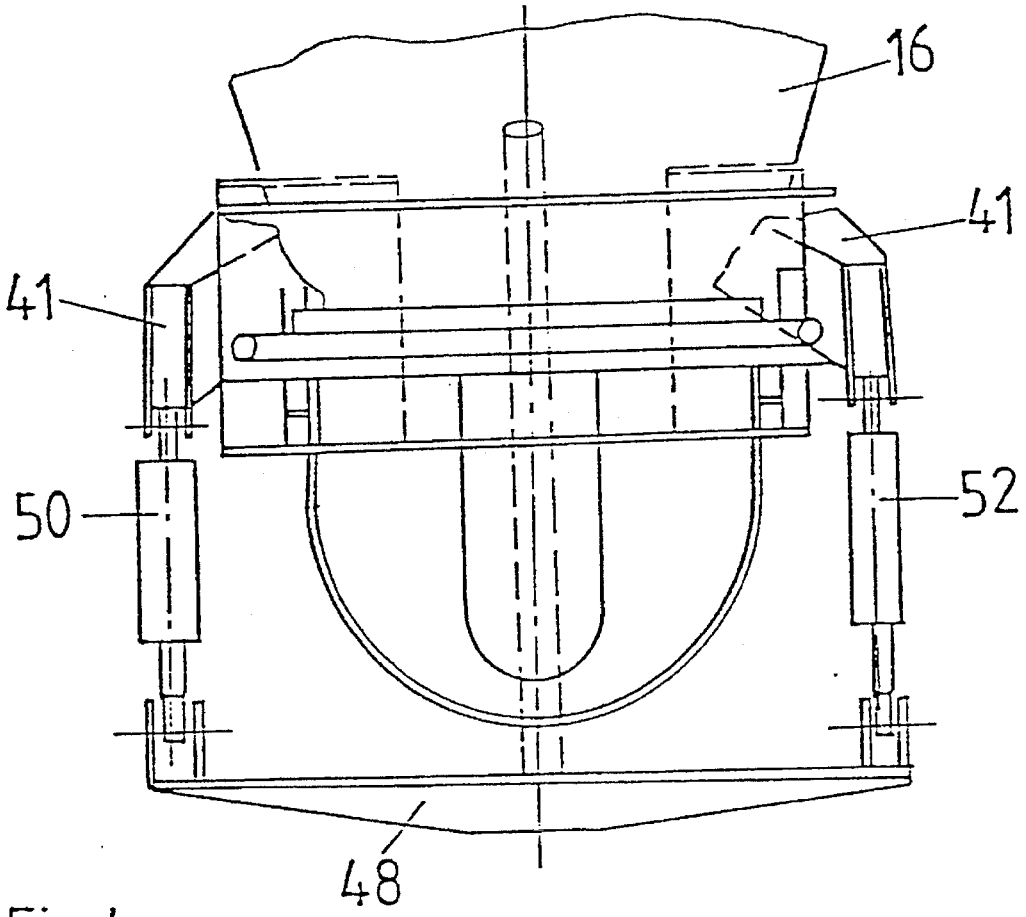
FIG. 4 is a top view onto the tail region of the mixing drum with depiction of a setting device for displacing the closure element.
Figure 5:
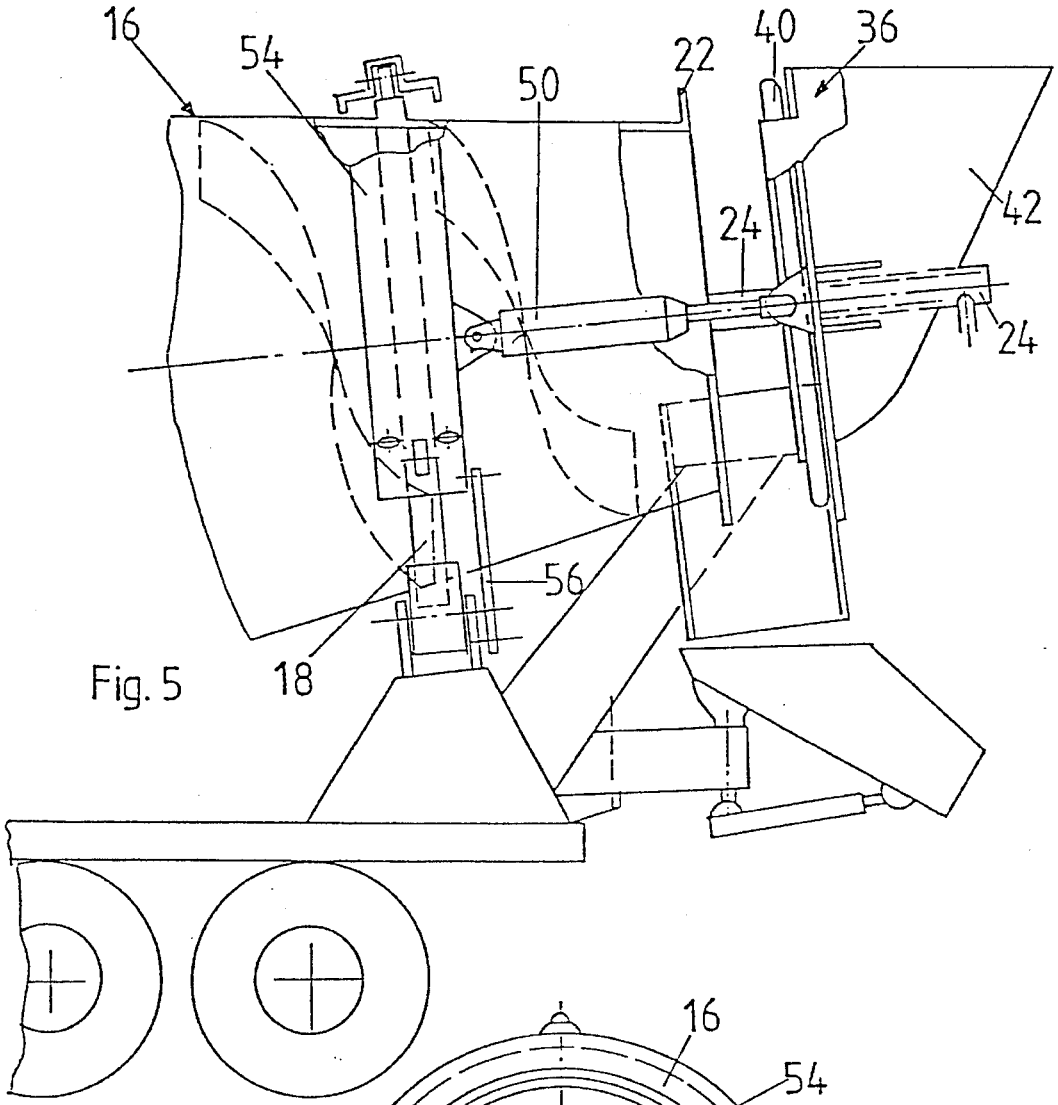
FIG. 5 is a side view of the tail region of the mixing drum with a modified suspension of the setting cylinders for the displaceable closure element.
Figure 6:
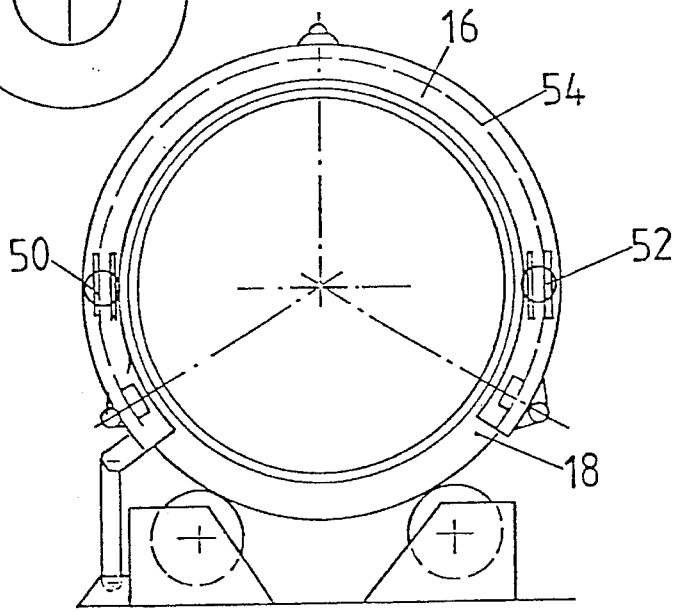
FIG. 6 is a tail view of the embodiment according to FIG. 5.

In the interior of the mixing drum is disposed a coaxial pipe 24 which is supported relatively rotatable and axially displaceable by means of a front bearing 26 and a rear bearing 28. The two bearings 26, 28 are mounted by means of star-shaped arms 30 on circumferential spiral or spirals 32 of the mixing drum 16. The bearing shells of bearings 26, 28 have a greater inner diameter than that corresponds to the outer diameter of the pipe 24. In the interior volume of the bearings 26, 28, are located abrasion sleeves 34 which are fastened on pipe 24 so as to be replaceable. The pipe 24 projects out of the drum mouth 20 and at its end is rigidly fastened a closure element 36 which comprises an annular wall 38 with annular seal or sealing 40 as well as a feeding hopper 42 penetrated by pipe 24. At the pipe end is fastened a U-shaped brace 44 welded to the side walls of the feeding hopper 42. Two bearing arms 41 extend upward from the bearing block 12. A torque bracing 46 layed out so that it prevents the swivelling of the feeding hopper 42 about the drum axis, is fastened to one of the bearing arms 41. Bracing 46, however, does not transmit relative motions between the drum with its moving mechanism and the hopper 42. A yoke 48, extending transversely of the brace 44, is engaged by two pressure cylinders 50, 52 which are disposed in an axial plane of the drum 16 and have their counterbearing according to FIG. 4, on the bearing arms 41 or, according to FIG. 5, in a bearing yoke 54, which is supported relatively rotatably on the running tread 18 of the mixing drum 16 and is secured by means of a rotation prevention device 56 against rotating with the drum 16. The bearing yoke 54 comprises several rollers which are supported on the bearing surface of the running tread 18, as well as rollers disposed at right angles to them which are in contact with the running tread on both faces thereof. The bearing yoke 54 forms consequently an abutment for the setting cylinders 50, 52 which, consequently, do not exert any force on the closure element due to deformations of the chassis resulting in the complete sealing of the drum, even while the vehicle is being driven.

By actuating the two setting cylinders 50, 52 which preferably are driven pneumatically, the constructional unit comprising closure element 36, feeding hopper 42 and pipe 24, is moved axially from the open position shown in FIG. 1 into a position of closure in which the annular seal 40 comes into contact with the annular flange 22 of the mixing drum 16. The annular wall 38 of the closure element 36 has a socket 58 directed in the forward direction, which rests on a smaller diameter than the annular seal 40. This socket 58 engages the interior of drum 16 and protects the annular seal 40.

Pipe 24 projects from hopper 42 and comprises, at the projecting end, a pressurized water connection 62 to which a pressurized water hose can be connected. Pipe 24 is provided axially with outlet nozzles 64 disposed at intervals over its entire length in the region of the mixing drum 16. Most of the nozzles are disposed in the upper half of pipe 24 and directed upwardly. Over the pipe 24, thus, mixing water can be added into the dry cement mixture uniformly distributed over the entire length of the drum. The outlet nozzles have closure means which close automatically when no pressurized water is supplied to the pipe, and open when pressurized water is supplied thereto.

What is claimed is:

1. A vehicle mixer with a chassis and for flowable media such as cement, the vehicle mixer comprising: a mixing drum having a tail drum mount and a running tread at its out circumference; rollers on the vehicle chassis for supporting the running tread for rotation of the mixing drum; a closure element with feeding hopper and annular seal for closing the drum mouth; a pipe coaxially penetrating the drum mouth and supported by the mixing drum, the pipe forming, with the closure element a constructional unit and being mounted to the drum for movement of the closure element between a closed position for closing the drum mouth with the annual seal and an open position; rotation preventions means connected between the constructional unit and the drum from securing the constructional unit against rotation; a setting device connected to the construction unit for moving the construction unit between its closed and open positions; the pipe extending at least through greatest portions of the length of the mixing drum; and at least two coaxial rotation and sliding bearings connected between the drum and the pipe for supporting the pipe on the drum.

2. A vehicle mixer as stated in claim 1, wherein feeding hopper is a component of the constructional unit comprising the closure element and the pipe.

3. A vehicle mixer as stated in claim 2, wherein the pipe in a region of its two coaxial rotating and sliding bearings in the mixing drum, includes removable abrasion sleeves therearound.

4. A vehicle mixer as stated in claim 3, wherein the setting device comprises two pressure cylinder means disposed bilaterally of the feeding hopper on the constructional unit and fastened on a bearing yoke which is supported relatively rotatably on the running tread of the mixing drum.

5. A vehicle mixer as stated in claim 4, wherein the annular seal is disposed outside of an abrasion protection socket on the closure element, projecting into the drum when the constructional unit is in its closed position.

6. A vehicle mixer as stated in claim 5, wherein the pipe comprised outside of the mixing drum a pressurized water connection and in the region of the drum a plurality of exit nozzles distributed over the length of the mixing drum.

7. A vehicle mixer as stated in claim 1, wherein the pipe in a region of its two coaxial rotating and sliding bearings in the mixing drum, includes removable abrasion sleeves therearound.

8. A vehicle mixer as stated in claim 1, wherein the setting device comprises two pressure cylinder means disposed bilaterally of the feeding hopper on the constructional unit and fastened on a bearing yoke which is supported relatively rotatably on the running tread of the mixing drum.

9. A vehicle mixer as stated in claim 1, wherein the annular seal is disposed outside of an abrasion protection socket on the closure element, projecting into the drum when the constructional unit is in its closed position.

10. A vehicle mixer as stated in claim 1, wherein the pipe comprised outside of the mixing drum a pressurized water connection and in the region of the drum a plurality of exit nozzles distributed over the length of the mixing drum.

11. A vehicle mixer as stated in claim 10, wherein at least some of the exit nozzles are directed upwardly.

12. A vehicle mixer as stated in claim 11, wherein the outlet nozzles comprise closure means which close the nozzles automatically in a pressureless state of the pipe and open the nozzles during a pressurized water supply thereto.

13. A vehicle mixer as stated in claim 11, wherein the pipe comprised outside of the mixing drum a pressurized water connection and in the region of the drum a plurality of exit nozzles distributed over the length of the mixing drum.

14. A vehicle mixer as stated in claim 10, wherein the outlet nozzles comprise closure means which close the nozzles automatically in a pressureless state of the pipe and open the nozzles during a pressurized water supply thereto.

* * * * *